US009114903B2

(12) United States Patent
Iwatsubo et al.

(10) Patent No.: US 9,114,903 B2
(45) Date of Patent: Aug. 25, 2015

(54) SQUEEZE CONTAINER

(75) Inventors: Mitsugu Iwatsubo, Tokyo (JP); Michiaki Fujita, Tokyo (JP)

(73) Assignee: Kao Corporation, Tokyo (JP)

( * ) Notice: Subject to any disclaimer, the term of this patent is extended or adjusted under 35 U.S.C. 154(b) by 416 days.

(21) Appl. No.: 12/989,741

(22) PCT Filed: Jun. 5, 2009

(86) PCT No.: PCT/JP2009/060719

§ 371 (c)(1),
(2), (4) Date: Oct. 26, 2010

(87) PCT Pub. No.: WO2009/151106

PCT Pub. Date: Dec. 17, 2009

(65) Prior Publication Data

US 2011/0204095 A1 Aug. 25, 2011

(30) Foreign Application Priority Data

Jun. 11, 2008 (JP) ..... 2008-153472
Sep. 1, 2008 (JP) ..... 2008-223875

(51) Int. Cl.
*B67D 7/56* (2010.01)
*B65D 1/32* (2006.01)

(52) U.S. Cl.
CPC ..... *B65D 1/32* (2013.01)

(58) Field of Classification Search
CPC ..... Y10S 215/90; B65D 1/32
USPC ..... 222/158, 206, 212, 213, 150, 21, 25, 222/26, 490, 494, 491, 34, 35; 215/231, 215/271, 900, 379, 11.5
See application file for complete search history.

(56) References Cited

U.S. PATENT DOCUMENTS 2,723,779 A * 11/1955 Parker et al. ..... 222/104
3,138,299 A * 6/1964 Staunton ..... 222/207

(Continued)

FOREIGN PATENT DOCUMENTS

DE 38 15 804 11/1989
JP 62-101769 6/1987

(Continued)

OTHER PUBLICATIONS

Office Action issued Aug. 18, 2011 in Chinese Application No. 200980116913.7 (with English translation).

(Continued)

*Primary Examiner* — Paul R Durand
*Assistant Examiner* — Jeremy W Carroll
(74) *Attorney, Agent, or Firm* — Oblon, McClelland, Maier & Neustadt, L.L.P.

(57) ABSTRACT

A squeeze container includes a container body having flexibility, and a press restriction member that is provided inside the container body and that restricts, from inside the container body, deformation of the container body due to pressing of a side surface of the container body from outside thereof. A content liquid of the container is discharged by pressing the side surface of the container body from outside thereof. The squeeze container has, on the side surface of the container body, measurement scale markings arrayed in the vertical direction. The inner diameter of the container body within an arrayed range in which the measurement scale markings are arrayed in the vertical direction is formed to have a smaller diameter than an upper portion and/or a lower portion of the container body. Further, there is a corresponding relationship between a position, in the vertical direction, on the array of the measurement scale markings and a discharge amount when that position is pressed.

20 Claims, 10 Drawing Sheets

(b)

1N

(56) References Cited

U.S. PATENT DOCUMENTS

| | | | | |
|---|---|---|---|---|
| 3,163,163 | A * | 12/1964 | Wilburn | 206/221 |
| 3,648,895 | A * | 3/1972 | Strazdins | 222/107 |
| 4,702,473 | A * | 10/1987 | Paquette | 482/74 |
| 5,337,924 | A | 8/1994 | Dickie | |
| 5,383,579 | A * | 1/1995 | Lanfranconi et al. | 222/129 |
| 6,193,886 | B1 * | 2/2001 | Nohren, Jr. | 210/282 |
| 6,626,331 | B2 * | 9/2003 | Yenglin | 222/187 |
| 6,755,357 | B2 * | 6/2004 | Duqueroie et al. | 239/327 |
| 6,789,704 | B2 * | 9/2004 | Hennessey et al. | 222/105 |
| 2001/0032862 | A1 | 10/2001 | Yenglin | |
| 2007/0187430 | A1 * | 8/2007 | Chen | 222/105 |
| 2010/0181277 | A1 * | 7/2010 | Brown et al. | 215/11.5 |

FOREIGN PATENT DOCUMENTS

| | | |
|---|---|---|
| JP | 2006-182429 | 7/2006 |
| JP | 2006 182429 | 7/2006 |

OTHER PUBLICATIONS

International Search Report issued Sep. 15, 2009 in PCT/JP09/60719 filed Jun. 5, 2009.

Office Action issued Jul. 1, 2011 in Europe Application No. 09 762 536.2.

* cited by examiner

1E

1F

1G

Transverse sectional view taken along line A–A

Transverse sectional view taken along line A-A

Transverse sectional view taken along line A–A

SQUEEZE CONTAINER

TECHNICAL FIELD

The present invention relates to a squeeze container.

BACKGROUND ART

In a squeeze container that discharges a content liquid by pressing from outside a container body having flexibility, it is known to provide a restriction tube, or a press engagement member, inside the container body for restricting the pressing amount thereof, and there are methods that vary the discharge amount of content liquid by varying the section at which to press the container body against the restriction tube in the vertical direction thereof (JP-U-62-101769), and that vary the discharge amount of content liquid by varying the section at which to press the container body in the circumferential direction thereof (JP-A-2006-182429).

Further, for cases where a prescribed amount of content liquid is to be discharged, it is proposed to provide marks on the outer wall of the container body for indicating the sections to be pressed (JP-A-2006-182429).

DISCLOSURE OF THE INVENTION

The present invention is a squeeze container including a container body having flexibility, and a press restriction member. The press restriction member is provided inside the container body and restricts, from inside the container body, deformation of the container body due to pressing of a side surface of the container body from outside thereof. A content liquid of the container is discharged by pressing the side surface of the container body from outside thereof. The side surface of the container body has measurement scale markings arrayed in the vertical direction. There is a corresponding relationship between a position, in the vertical direction, on the array of the measurement scale markings and a discharge amount when that position is pressed.

BRIEF DESCRIPTION OF THE DRAWINGS

FIG. 1(*b*) is a side perspective of the squeeze container.
FIG. 4(*b*) is a side perspective of the squeeze container.
FIG. 8(*b*) is a side perspective of the squeeze container.
FIG. 8(*c*) is a transverse sectional view of the squeeze container taken along line A-A.
FIG. 9(*b*) is a side perspective of the squeeze container.
FIG. 10(*b*) is a side perspective of the squeeze container.
FIG. 11(*b*) is a side perspective of the squeeze container.
FIG. 11(*c*) is a transverse sectional view of the squeeze container taken along line A-A.
FIG. 12(*b*) is a side perspective of the squeeze container.
FIG. 13(*b*) is a side perspective of the squeeze container.

FIG. 16(*b*) is a side perspective of the squeeze container.
FIG. 16(*c*) is a transverse sectional view of the squeeze container taken along line A-A.

DETAILED DESCRIPTION OF THE INVENTION

Figure 1A:
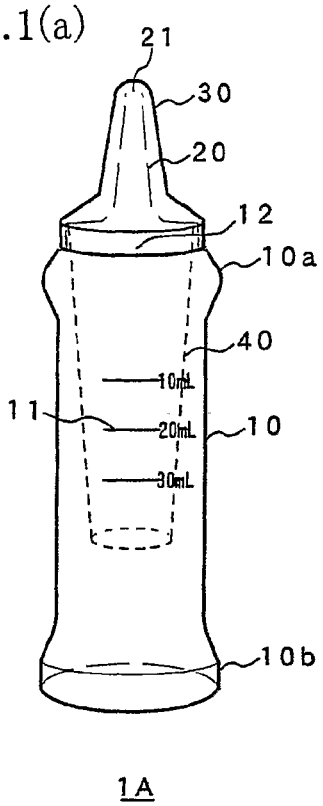
FIG. 1(*a*) is a front perspective of a squeeze container.

The squeeze container disclosed in JP-U-62-101769 can increase or reduce, i.e., roughly vary the discharge amount by varying the pressing position. However, it is not possible to discharge a desired amount. Further, in the squeeze container disclosed in JP-A-2006-182429, it is not possible to perceive the section to be pressed in cases where it is desired to discharge an amount of content liquid that differs from the discharge amount indicated on the outer wall of the container body, thus making it difficult to discharge the content liquid at a desired discharge amount. Particularly, it is difficult to discharge the content liquid at a desired discharge amount, in case of using a deformed container whose container body is formed so that its central portion is narrower in diameter compared to the upper portion and/or lower portion thereof or formed so that a portion of the side surface of the central portion is flattened, in order to improve the holdability of the squeeze container.

Meanwhile, the standard (recommended) amount is prescribed for laundry cleaning agents and softeners, for example. However, it is common for users to arbitrarily vary the necessary amount of liquid depending on, for example, the size of the washing tub and/or the amount of laundry. Accordingly, there has been a demand for the development of a squeeze container capable of discharging a fixed amount of liquid at a desired discharge amount.

Further, with a conventional squeeze container, it is necessary to confirm, from both directions, the two positions at which to hold and press the container body in order to discharge a prescribed amount of content liquid by pressing of the container body. For example, in case of the container disclosed in Patent Document 2, in order to discharge the content liquid so that the discharge amount becomes "large", it is necessary to place the thumb on the "large" mark while placing the rest of the fingers, in a vertically aligned manner, at a position right on the opposite side from the "large" mark upon holding the container body with one hand.

In doing so, if the container or the hand is in a slippery state, e.g., if the container is cylindrical or the container or the hand is wet, then the positions pressed by the thumb and the rest of the fingers may deviate from the actual mark and the position opposite therefrom.

The present invention relates to a squeeze container capable of discharging a fixed amount of content liquid at a desired discharge amount.

Further, in discharging a prescribed amount of content liquid from the squeeze container, the present invention improves the ease of holding the container body, facilitates positioning of the fingers which are to be placed on the container body, and thus allows the liquid to be discharged at a fixed amount more simply.

The present invention is a squeeze container including a container body having flexibility, and a press restriction member. The press restriction member is provided inside the container body and restricts, from inside the container body, deformation of the container body due to pressing of a side surface of the container body from outside thereof. A content liquid of the container is discharged by pressing the side surface of the container body from outside thereof. The side surface of the container body has measurement scale markings arrayed in the vertical direction. There is a corresponding relationship between a position, in the vertical direction, on the array of the measurement scale markings and a discharge amount when that position is pressed.

Preferably, in the squeeze container of the present invention, a transverse sectional shape of an outer contour of the container body within the arrayed range in which the measurement scale markings are arrayed in the vertical direction is convex and is substantially linear on an opposite side from the arrayed area, and a distance between an inner wall of the container body and the press restriction member differs within the arrayed area of the measurement scale markings depending on the positions where the measurement scale markings are provided, and is constant on the opposite side from the arrayed area.

The following describes the present invention in detail with reference to the drawings. In the figures, the same reference characters are used to indicate the same or like components.

Figure 1B:
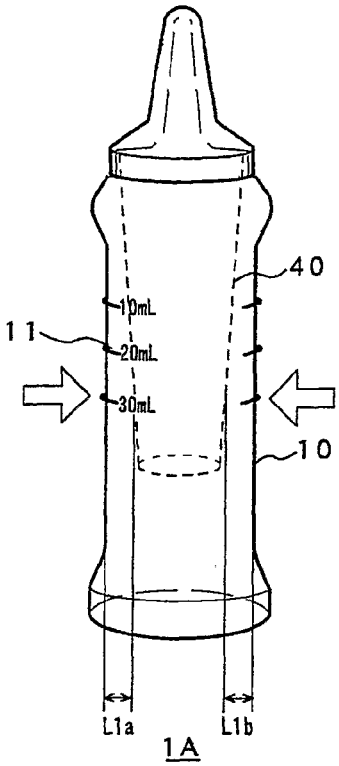

FIG. 1(*a*) is a front perspective of a squeeze container 1A according to an embodiment of the present invention, and FIG. 1(*b*) is a side perspective thereof.

The squeeze container 1A includes a container body 10 that contains a content liquid, a nozzle cap 20 that is detachably mounted on a mouth of the container body 10, a cover 30 that is detachably mounted on the container body 10 from above the nozzle cap 20 to cover up the nozzle cap 20, and a press restriction member 40 that is provided inside the container body 10.

A nozzle orifice provided in the tip end of the nozzle cap can take any shape/size as long as the contents of the container can be easily discharged, and can be adjusted depending on the physical properties of the contents.

An array of measurement scale markings 11 arrayed in the vertical direction is provided on each of the front and back of the side surface of the container body 10. Each measurement scale marking 11 projects like a rib. The discharge amounts of content liquid (e.g., 10 mL, 20 mL, and 30 mL) when the respective measurement scale markings 11 are pressed in the direction of the arrows as shown in FIG. 1(*b*) are indicated on the surface of the container body 10 at appropriate numerical intervals.

The container body 10 has a bottom and is substantially cylindrical, but an arrayed range in which the measurement scale markings 11 are arrayed in the vertical direction is formed to have a smaller diameter than the upper portion 10*a* and the lower portion 10*b* of the container body 10. Such a structure makes it easy to hold the area around the arrayed range of the measurement scale markings 11 with one hand, and further, pressing a measurement scale marking 11 while holding the container with one hand allows the pressed section to be easily depressed up to the position of the press restriction member 40. In the present invention, it will suffice if the inner diameter at least within the arrayed range in which the measurement scale markings 11 are arrayed in the vertical direction is made smaller than either one of the upper portion 10*a* or the lower portion 10*b* of the container body 10 to improve the holdability of the container body 10.

Further, the container body 10 is made of plastic having flexibility, and preferably, made of plastic also being transparent or translucent to such a degree that allows the liquid level of the content liquid to be visually confirmed from outside the container body 10. Accordingly, depressing the container body 10 by pressing the side surface of the container body 10 from outside thereof causes the content liquid contained in the container body 10 to be discharged from a discharge orifice 21 at the tip end of the nozzle cap 20 at an amount corresponding to the depressed amount.

Meanwhile, the press restriction member 40 is for restricting, from inside the container body 10, deformation of the container body 10 due to pressing of the side surface from outside thereof. In the present embodiment, the press restriction member 40 is formed of a tubular member hanging down from the vicinity of an opening 12 of the container body 10, and is made, for example, of a plastic material that does not deform due to pressing of the side surface of the container body 10 from outside thereof, but it will suffice if the press restriction member 40 substantially does not deform. Further, in the present embodiment, assuming that the height from the upper edge of the shoulder of the container body 10 to the bottom thereof is H1 and the height to the lower opening of the press restriction member 40 is H2, it is preferable that the press restriction member 40 is provided hanging down up to a position where H2/H1 is around ¼ to ⅚. Further, it is preferable to set the height H1 from the upper edge of the shoulder of the container body 10 to the bottom thereof to around 10 to 20 cm.

The outer contour of the press restriction member 40 is formed so that, when the container body 10 is pressed in the direction of the arrows as shown in FIG. 1(*b*) within the arrayed range in which the measurement scale markings 11 are arrayed in the vertical direction, there is a corresponding linear relationship between the amount of depression at the pressed section—i.e., the sum (L1*a*+L1*b*) of a distance L1*a* between the inner wall on the front side of the container body 10 and the press restriction member 40 and a distance L1*b* between the inner wall on the back side and the press restriction member 40—and the position, in the vertical direction, on the array of measurement scale markings 11. More specifically, the container body 10 is formed in a cylindrical shape having a constant inner diameter within the arrayed range in which the measurement scale markings 11 are arrayed in the vertical direction, whereas the press restriction member 40 is formed in an inverted tapered shape in which the upper-portion diameter is larger than the lower-portion diameter and its diameter is adjusted so that the above-described corresponding relationship is satisfied.

Accordingly, when discharging a desired discharge amount of content liquid using the present squeeze container 1A, if the discharge amount is indicated as a numerical value on the measurement scale marking 11, then the portion at that measurement scale marking can simply be pressed. Even if the desired discharge amount is not indicated as a numerical value on the measurement scale marking 11, the container can be pressed at a position found by proportionally dividing between the measurement scale markings 11 that are indicated. In this way, it becomes possible to discharge a fixed amount of liquid at a desired discharge amount within the range in which the measurement scale markings 11 are provided. For example, in case where the values 10 mL, 20 mL, and 30 mL are displayed on the measurement scale markings 11 as shown in FIG. 1(*a*), the position in the middle of the measurement scale markings having 10 mL and 20 mL can be pressed in order to discharge 15 mL.

Figure 2:
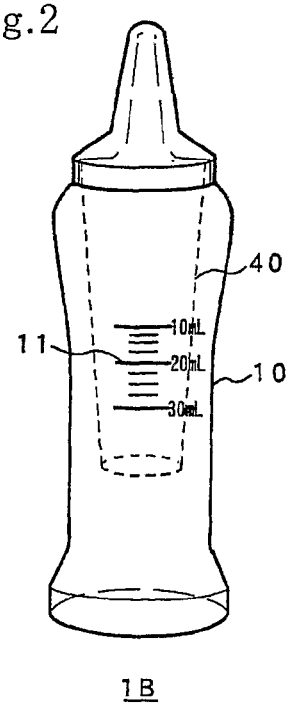
FIG. 2 is a front perspective of a squeeze container.

Note that in the present invention, the expression "there is a corresponding relationship between a position, in the vertical direction, on the array of the measurement scale markings 11 and the discharge amount when that position is pressed" refers to a state in which there is a corresponding relationship between the position, in the vertical direction, on the array of the measurement scale markings of the container body and the discharge amount when the side surface of the container body is pressed at that position from outside. In other words, it can be stated that the two variables—i.e., the magnitude of the numerical value of the scale marking and the magnitude of the discharge amount—are so related as to have a linear relationship (mutual relation). The relationship does not have to be exactly corresponding, and it will suffice if the discharge amount can be adjusted by proportionally dividing the interval between the indicated measurement scale markings in units equal to or less than half the interval, and more preferably in increments of around one-fifth to one-half of the interval. Further, in cases where the measurement scale markings 11 are provided with a plurality of scale markings respectively corresponding to different discharge amounts with constant increments, the intervals between the scale markings do not have to be even. As in the squeeze container 1B shown in FIG. 2, the intervals between the scale markings may gradually narrow, or conversely widen, as the numerical value decreases from a larger value to a smaller value.

In the squeeze container of the present invention, there is no limitation to the shape of the nozzle cap 20. The container body 10 and the press restriction member 40 can also be shaped in various forms as long as there is a corresponding linear relationship between the position, in the vertical direction, on the array of the measurement scale markings 11 and the discharge amount when that position is pressed.

Figure 3:
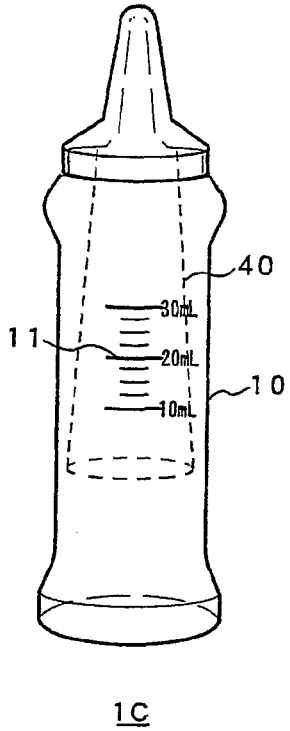
FIG. 3 is a front perspective of a squeeze container.

For example, as in the squeeze container 1C shown in FIG. 3, the container body 10 may have the same shape as the squeeze container 1A shown in FIGS. 1(*a*) and 1(*b*) but the press restriction member 40 may be formed in a tapered shape in which the upper-portion diameter is smaller than the lower-portion diameter, and thus the discharge amount corresponding to a scale marking located in the upper section among the measurement scale markings 11 may be made larger than the discharge amount corresponding to a scale marking located in the lower section.

Figure 4A:
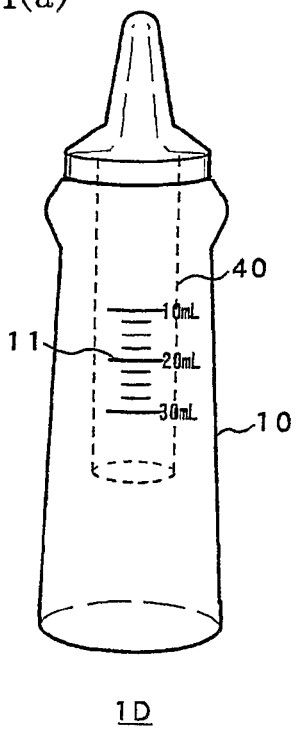
FIG. 4(*a*) is a front perspective of a squeeze container.
Figure 4B:
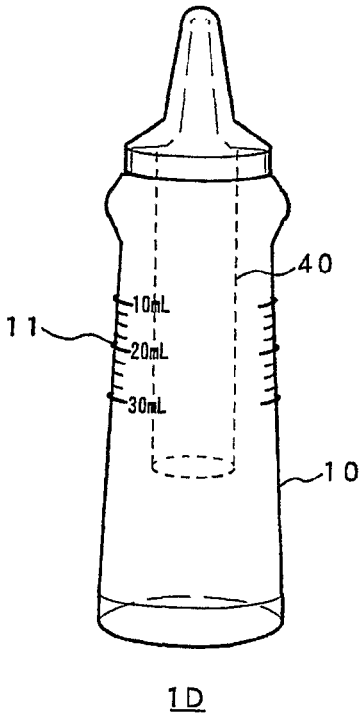
Figure 5:
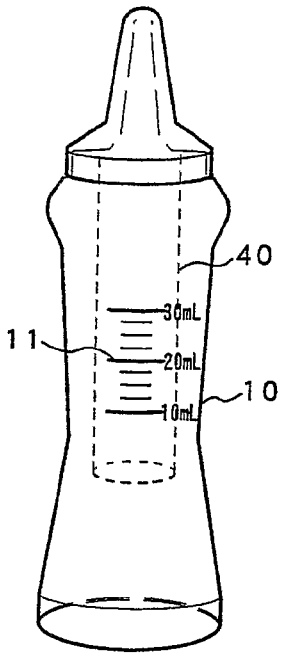
FIG. 5 is a front perspective of a squeeze container.

Further, as in the squeeze container 1D shown in FIGS. 4(*a*) and 4(*b*), within the range in which the measurement scale markings 11 are arrayed in the vertical direction, the press restriction member 40 may be formed as a tube having a constant diameter and the container body 10 may be formed in a tapered shape in which the upper section has a smaller diameter and the lower section has a larger diameter. Instead, as in the squeeze container 1E shown in FIG. 5, within the range in which the measurement scale markings 11 are arrayed in the vertical direction, the press restriction member 40 may be formed as a tube having a constant diameter and the container body 10 may be formed in an inverted tapered shape in which the upper section has a larger diameter and the lower section has a smaller diameter.

Figure 6:
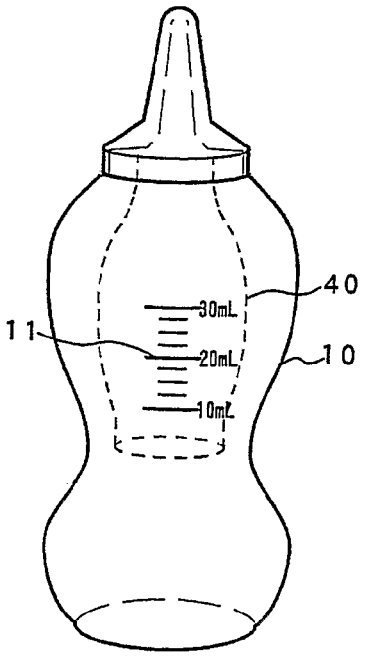
FIG. 6 is a front perspective of a squeeze container.
Figure 7:
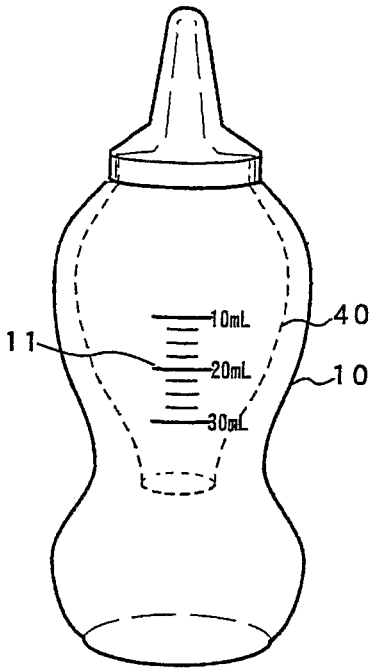
FIG. 7 is a front perspective of a squeeze container.

Furthermore, as in the squeeze containers 1F and 1G shown in FIGS. 6 and 7, the container body 10 may be gourd-shaped in which the portion to be held is narrowed, and corresponding to this shape, the press restriction member 40 may be bell-shaped, with either the upper or lower section being wide in diameter, within the range in which the measurement scale markings 11 are arrayed in the vertical direction.

Figure 8A:
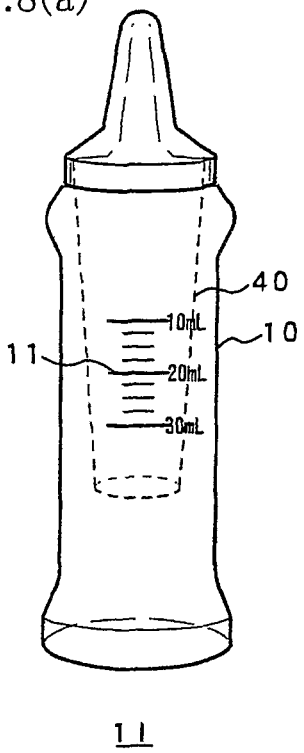
FIG. 8(*a*) is a front perspective of a squeeze container.
Figure 8B:
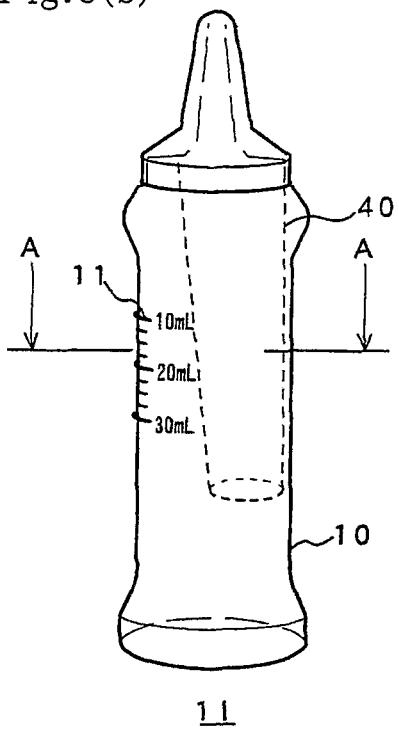
Figure 8C:
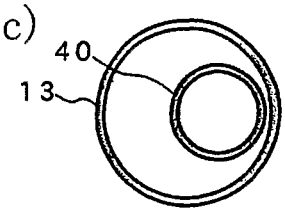

The squeeze container 1I shown in FIGS. 8(*a*), 8(*b*), and 8(*c*) has the measurement scale markings 11 provided only on the front side of the side surface of the container body 10, and a cylindrical press restriction member 40 is provided close to or in contact with a back side of the container body 10 which is on the opposite side from the front side provided with the measurement scale markings 11. Such a structure can also achieve the effect of adjusting the pressing position using only the thumb, like the squeeze container 1H described further below.

Figure 9A:
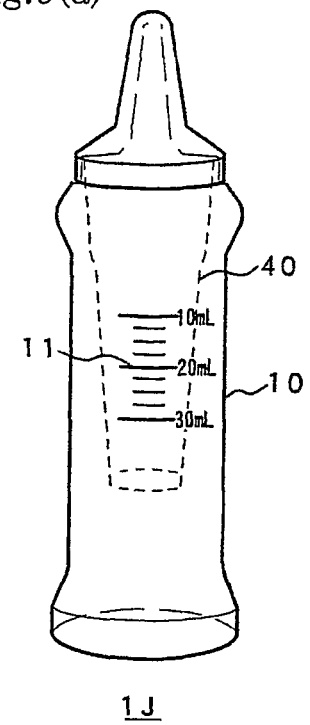
FIG. 9(*a*) is a front perspective of a squeeze container.
Figure 9B:
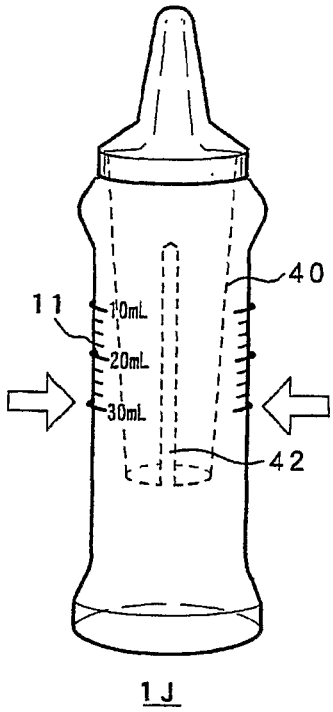

The present invention can further take various forms. For example, as in the squeeze container 1J shown in FIGS. 9(*a*) and 9(*b*), a slit 42 may be provided in the axial direction of the tubular press restriction member 40. In this way, when the array of the measurement scale markings 11 is pressed, it is possible to feel the slit 42 close when the amount of press-deformation of the container body 10 has reached a sufficient amount for the container body 10 to come into contact with the press restriction member 40. Taking this feeling as a guide, the container body 10 can be pressed.

Figure 10A:
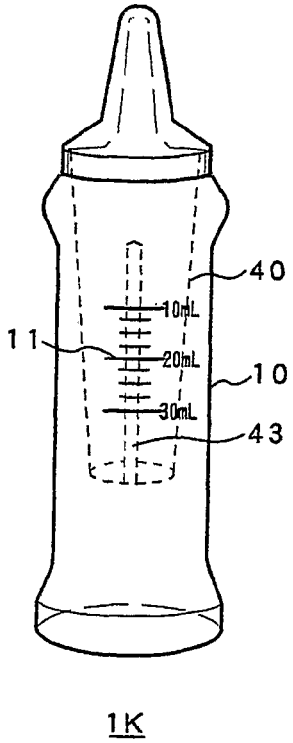
FIG. 10(*a*) is a front perspective of a squeeze container.
Figure 10B:
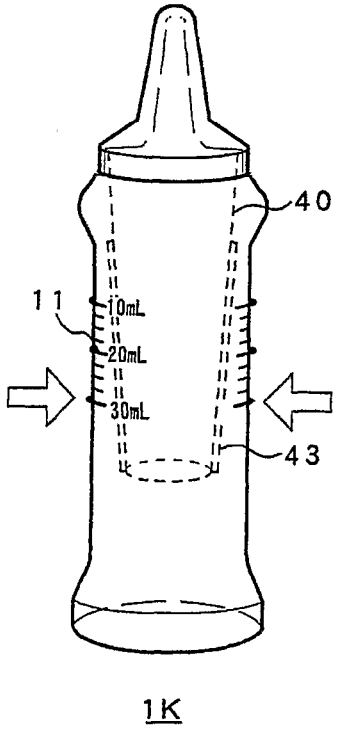

Further, as in the squeeze container 1K shown in FIGS. 10(*a*) and 10(*b*), a rib 43 may be formed along the axial direction of the press restriction member 40 on the surface thereof on the side of the measurement scale markings 11. In this way, when the array of the measurement scale markings 11 is pressed, it is possible to feel the finger(s) reach the rib 43 when the amount of press-deformation of the container body 10 has reached a sufficient amount for the container body 10 to come into contact with the press restriction member 40, which allows the container body 10 to be pressed taking this feeling as a guide.

The slit 42 and/or the rib 43 may be provided in any of the above-described squeeze containers 1A to 1I.

Figure 11A:
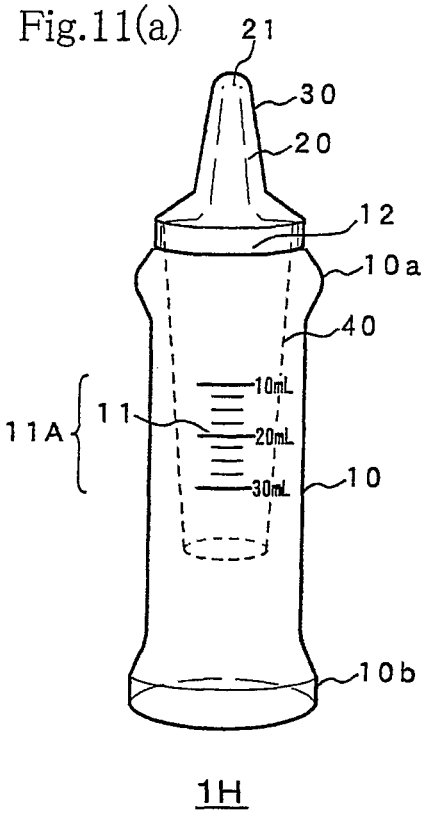
FIG. 11(*a*) is a front perspective of a squeeze container.
Figure 11B:
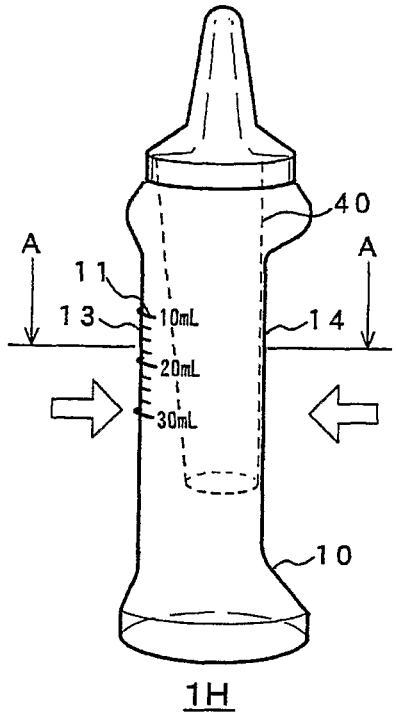
Figure 11C:
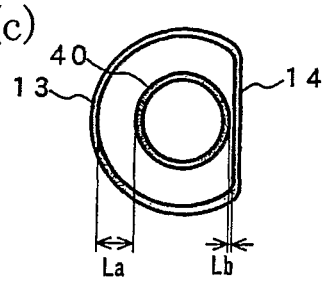

FIG. 11(*a*) is a front perspective of a squeeze container 1H according to another embodiment of the present invention, FIG. 11(*b*) is a side perspective thereof, and FIG. 11(*c*) is a transverse sectional view taken along line A-A of FIG. 11(*b*).

The squeeze container 1H includes a container body 10 that contains a content liquid, a nozzle cap 20 that is detachably mounted on a mouth of the container body 10, a cover 30 that is detachably mounted on the container body 10 from above the nozzle cap 20 to cover up the nozzle cap 20 and that closes off the discharge orifice 21, and a press restriction member 40 that is provided inside the container body 10.

An array of measurement scale markings 11 arrayed in the vertical direction is provided on the side surface of the container body 10. Each measurement scale marking 11 projects like a rib. The discharge amounts of content liquid (e.g., 10 mL, 20 mL, and 30 mL) when the respective measurement scale markings 11 are pressed in the direction of the arrows as shown in FIG. 11(*b*) are indicated on the surface of the container body 10 at appropriate numerical intervals. Other than measurement scale markings 11 that project like ribs, the markings may be formed as depressions or may be printed.

The container body 10 has a bottom and is substantially tubular, but the transverse sectional shape of the outer contour thereof within the arrayed range 11A in which the measurement scale markings 11 are arrayed in the vertical direction is convex—more specifically, arc-shaped—on the front side of the container body 10 that constitutes the arrayed area in which the measurement scale markings 11 are arrayed, and is substantially linear on the back area which is on the opposite side from the arrayed area, and is thus D-shaped as a whole consisting of an arc portion 13 and a linear portion 14. Accordingly, the container body is so shaped that it can be held just by placing the thumb on the front side of the container body that constitutes the arrayed area of the measurement scale markings 11 and placing the rest of the fingers on the substantially-linear back area located on the opposite side therefrom.

The expression "the transverse sectional shape of the outer contour of the container body 10 is substantially linear on the opposite side from the arrayed area in which the measurement scale markings 11 are arrayed" used herein refers to a state in which the outer contour line in an area opposing the measurement scale markings 11 is either a straight line or a convex or concave curved line whose radius of curvature is equal to or above 60 mm, at least across the width of around 20 mm that is to be held with the cushion of the fingers, and includes cases where the outer contour line has, for example, projections and depressions formed thereon to prevent slipping.

Further, in the container body 10, the arrayed range 11A in which the measurement scale markings 11 are arrayed in the vertical direction is formed to have a smaller diameter than the upper portion 10*a* and the lower portion 10*b* of the container body. Such a structure makes it easy to hold the area around the arrayed range 11A of the measurement scale markings 11 with one hand. In the present embodiment, the diameter of the container body 10 is constant within the arrayed range 11A in which the measurement scale markings 11 are arrayed in the vertical direction.

The container body 10 is made of plastic having flexibility. Accordingly, pressing the container body 10 to depress the container body 10 causes the content liquid contained in the container body 10 to be discharged from the discharge orifice 21 at the tip end of the nozzle cap 20 at an amount corresponding to the depressed amount. In this case, it is preferable that the plastic forming the container body 10 is transparent or translucent to such a degree that allows the liquid level of the content liquid to be visually confirmed from outside the container body 10.

Meanwhile, the press restriction member 40 is for restricting press-deformation of the container body 10 from inside the container body 10. In the present embodiment, the press restriction member 40 is formed of a tubular member hanging down from the vicinity of the opening 12 of the container body 10 in such a design that the press restriction member 40 is located close to the back area of the container body 10. The tubular member has an inverted tapered shape in which the diameter on the upper end side of the measurement scale markings 11 is larger than the diameter on the lower end side. Therefore, on the front side of the container body 10 that constitutes the arrayed area in which the measurement scale markings 11 are arrayed, a distance La between the inner wall of the container body 10 and the press restriction member 40 differs depending on the positions where the measurement scale markings 11 are provided. On the other hand, in the back area which is on the opposite side therefrom, a distance Lb between the inner wall of the container body 10 and the press restriction member 40 is constant, at least within an area opposing the arrayed range 11A in which the measurement scale markings 11 are arrayed in the vertical direction. The expression "the distance Lb is constant" used herein does not necessarily mean that a constant interval is strictly maintained, but there may be slight variations in the distance Lb as long as the discharge amount does not vary depending on the position where the back area is pressed. Further, the distance Lb between the inner wall of the container body 10 and the press restriction member 40 in this back area is preferably equal to or below one-fifth as compared to the distance La between the inner wall of the container body 10 and the press restriction member 40 on the front side, and the press restriction member 40 may be placed in contact with the inner wall of the container body so that the distance Lb becomes zero. Making the distance Lb in the back area smaller than the distance La on the front side as described above allows the discharge amount to become stable.

Now, in order to discharge a desired discharge amount of content liquid from the squeeze container 1H, the thumb is placed on a position corresponding to the desired discharge amount on the side of the arc portion of the container body 10 within the arrayed area of the measurement scale markings 11, whereas in the substantially-linear back area on the opposite side therefrom, the rest of the fingers are placed on a position where it is easy to hold the container body 10, and in this state, the container body 10 is pressed in the direction of the arrows as shown in FIG. 11(*b*). In doing so, it is unnecessary to adjust the rest of the fingers on a position corresponding to the discharge amount in the back area of the container body 10. This squeeze container 1H thus allows a desired discharge amount of content liquid to be discharged with extreme ease, simply by holding the container body with the four fingers on the back and the thumb on the front and pressing a position corresponding to the discharge amount with the thumb.

Figure 12A:
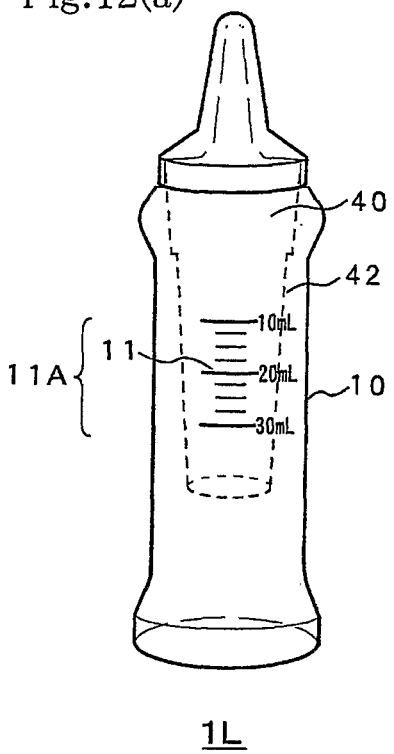
FIG. 12(*a*) is a front perspective of a squeeze container.
Figure 12B:
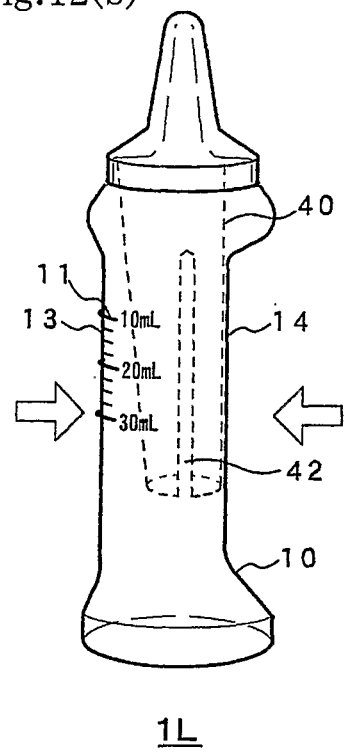

In the present invention, the press restriction member 40 can further take various forms. For example, as in the squeeze container 1L shown in FIGS. 12(*a*) and 12(*b*), a slit 42 may be provided in the axial direction of the tubular press restriction member 40. In this way, when the array of the measurement scale markings 11 is pressed, it is possible to feel the slit 42 close when the amount of press-deformation of the container body 10 has reached a sufficient amount for the container body 10 to come into contact with the press restriction member 40. Taking this feeling as a guide, the container body 10 can be pressed.

Figure 13A:
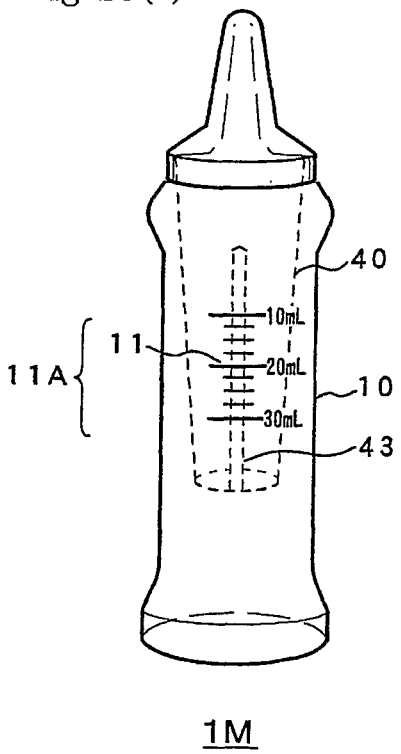
FIG. 13(*a*) is a front perspective of a squeeze container.
Figure 13B:
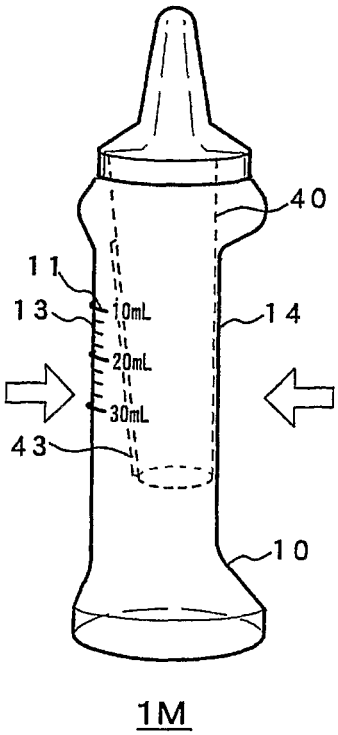

As in the squeeze container 1M shown in FIGS. 13(*a*) and 13(*b*), a rib 43 may be provided along the axial direction of the press restriction member 40 on the surface thereof on the side of the measurement scale markings 11. In this way, when the array of the measurement scale markings 11 is pressed, it is possible to feel the finger(s) reach the rib 43 when the amount of press-deformation of the container body 10 has reached a sufficient amount for the container body 10 to come into contact with the press restriction member 40. Taking this feeling as a guide, the container body 10 can be pressed.

Figure 14:
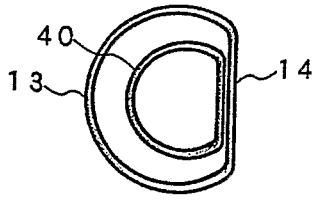
FIG. 14 is a transverse sectional view of a squeeze container.
Figure 15:
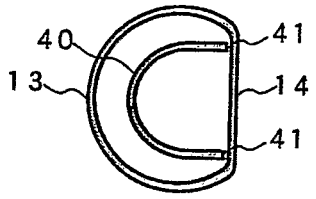
FIG. 15 is a transverse sectional view of a squeeze container.

Furthermore, the transverse sectional shape of the press restriction member 40 in FIG. 11(*c*) may be flattened, so that as shown in FIG. 14, the press restriction member 40 is arc-shaped on the side of the arc portion 13 of the container body 10 and is linear on the side of the linear portion 14 of the container body 10, thus being D-shaped or semicircular substantially similar to the transverse sectional shape of the container body 10 as a whole. Instead, as shown in FIG. 15, the transverse sectional shape of the press restriction member 40 may be U-shaped with the two side edges 41 of the press restriction member 40 abuting the inner wall of the container body 10 on the side of the linear portion 14 of the container body 10.

Figure 16A:
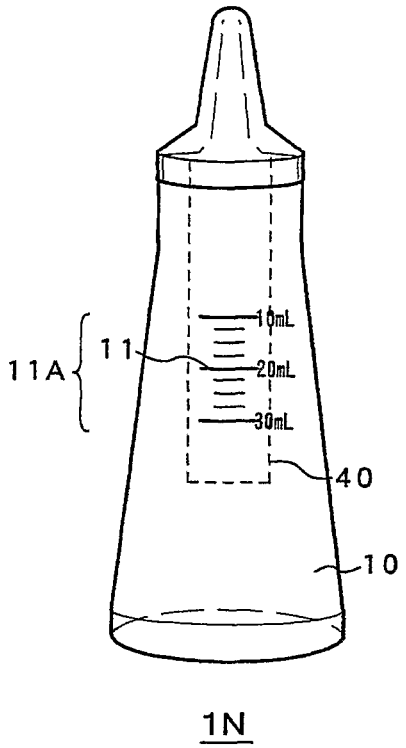
FIG. 16(*a*) is a front perspective of a squeeze container.
Figure 16B:
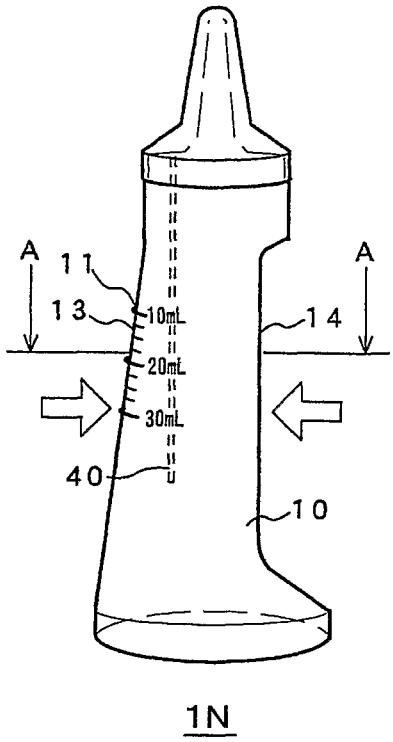
Figure 16C:
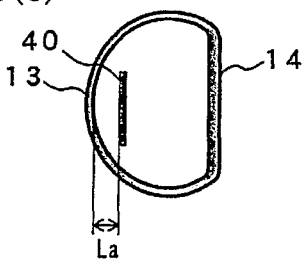

Furthermore, as in the squeeze container 1N shown in FIGS. 16(*a*), 16(*b*), and 16(*c*), the diameter of the container body 10 within the arrayed range 11A in which the measurement scale markings 11 are arrayed in the vertical direction may be set so that the upper portion becomes narrower in diameter than the lower portion, and a plate-like member may be provided in a hanging state inside the container body 10 as the press restriction member 40. According to this squeeze container 1N as well, in the arrayed area of the measurement scale markings 11, the distance La between the inner wall of the container body 10 and the press restriction member 40 differs depending on the positions where the measurement scale markings 11 are provided. Therefore, it is possible to discharge a desired discharge amount of content liquid simply by placing the thumb on a position corresponding to the desired discharge amount within the arrayed area of the measurement scale markings 11 on the container body 10 while placing the rest of the fingers on a position where it is easy to hold the container body 10 in the substantially-linear back area on the opposite side therefrom and pressing the container body 10 in the direction of the arrows shown in FIG. 16(*b*).

In such an embodiment that employs a plate-like member as the press restriction member 40, the substantially-linear back area of the container body 10 may be formed thick to make this portion less prone to depression.

The squeeze container of the present invention being structured as above, it is possible, upon use, to discharge a prescribed amount of its contents from the tip end of the nozzle cap by first removing the cap, then turning the container body containing the contents upside-down, and pressing a prescribed scale-marking position on the side surface of the container body.

With the squeeze container of the present invention, appropriately modifying the size, shape, etc. of the discharge orifice of the nozzle cap 20 allows various content liquids to be used. For example, setting the size of the discharge orifice of the nozzle cap 20 to 1 to 10 mm will allow the squeeze container to be suitably used for discharging a fixed amount of laundry cleaning agent, softener, bleaching agent, dishwasher cleaning agent, or the like having a viscosity of 1 to 10,000 mPa·s (20° C.).

In the squeeze container of the present invention, the nozzle cap 20 is not limited whatsoever as to its shape, and it may have an applicator such as a brush depending on the use thereof.

Examples

<Confirming and Evaluating Linearity Between Pressed Section and Discharge Amount>

The specifications of a squeeze container 1A having the shape as shown in FIG. 1 were set as follows. The relationship between the pressed position on the array of measurement scale markings 11 and the discharge amount upon pressing the position was investigated, and the following results were obtained. In this example, the viscosity of the content liquid was 1.0 mPa·s (25° C. on a Model B viscometer).

[Specifications of Squeeze Container]

Diameter of bottle within arrayed range of measurement scale markings: ø56 mm

Diameter of press restriction member at first scale marking: ø34 mm

Diameter of press restriction member at second scale marking (20 mm below first scale marking): ø31.5 mm Diameter of press restriction member at third scale marking (40 mm below first scale marking): ø29 mm Inner diameter of discharge orifice: ø4 mm

[Discharge Amount Measurement Results]

Discharge amount at first scale marking: approx. 25 ml

Discharge amount in the middle of first and second scale markings: approx. 27 to 28 ml Discharge amount at second scale marking: approx. 30 ml Discharge amount in the middle of second and third scale marking: approx. 32 to 33 ml Discharge amount at third scale marking: approx. 35 ml As shown above, it was confirmed that there is a linear relationship between the positions of the scale markings and the respective discharge amounts. It was also confirmed that there is a corresponding (linear) relationship between the pressing position and the discharge amount even when a position in between two scale markings is pressed.

INDUSTRIAL APPLICABILITY

The squeeze container of the present invention is useful as a container for discharging laundry cleaning agents, softeners, bleaching agents, dishwasher cleaning agents, and the like.

Further, in the squeeze container of the present invention, there is a corresponding relationship between the position, in the vertical direction, on the array of the measurement scale markings of the container body and the discharge amount when the side surface of the container body is pressed at that position from outside. Accordingly, in cases where a desired discharge amount is directly indicated on one of the measurement scale markings, the desired discharge amount of content liquid can be discharged by pressing the position where the indication is provided, and in cases where a desired discharge amount is not directly indicated on one of the measurement scale markings, the desired amount can be discharged by pressing the position between a discharge amount indication on one of the measurement scale markings and a discharge amount indication on an adjacent measurement scale marking.

Further, in the squeeze container of the present invention, the side surface of the container body has measurement scale markings, and the inner diameter of the container body within an arrayed range in which the measurement scale markings are arrayed in the vertical direction is formed to have a smaller diameter than the upper portion and/or the lower portion of the container body. Accordingly, the section for holding and pressing the container body is made narrow in diameter than the upper portion and/or the lower portion of the container body, thereby improving the holdability.

Furthermore, in the squeeze container of the present invention, the transverse sectional shape of the outer contour of the container body is convex within an arrayed area in which the measurement scale markings are arrayed and is linear on the opposite side therefrom, and thus one side of the container body is made flat. Such a shape is easier to hold than where the container body is cylindrical.

Further, upon holding the container, placing the thumb on the convex side while placing the rest of the fingers on the opposite flat area allows the orientation in which the container body is grasped to naturally become constant. Further, the measurement scale markings are provided on the side where the thumb is placed. Moreover, in the arrayed area of the measurement scale markings, the distance between the inner wall of the container body and the press restriction member differs depending on the position where each measurement scale marking is provided, whereas in the flat area on the opposite side for placing the rest of the fingers, the distance between the inner wall of the container body and the press restriction member is constant. Therefore, it is only necessary to confirm the position of the thumb in order to discharge a prescribed amount of content liquid, and there is no need to confirm the positions of the rest of the fingers. Accordingly, the squeeze operation for discharging a prescribed amount of content liquid can be achieved easily.

The invention claimed is:

1. A squeeze container comprising:

a container body having flexibility, and a press restriction member that is provided inside the container body and that restricts, from inside the container body, deformation of the container body due to pressing of a side surface of the container body from outside thereof, a content liquid of the container being discharged by pressing the side surface of the container body from outside thereof, wherein:

the press restriction member defines limits to a deformation amount that the container body deforms based on a position in a vertical direction of the container body, such that the limits vary with respect to the vertical direction;

the side surface of the container body has an array of measurement scale markings that are arrayed in the vertical direction;

the deformation amount, for a particular position in the vertical direction, corresponds to a discharge amount of the content liquid that is discharged when the container body is pressed to one of the limits, such that the discharge amount corresponds to one of the measurement scale markings that coincides with the particular position in the vertical direction; and within a range in which the measurement scale markings are arrayed in the vertical direction on the side surface of the container body, one of the side surface of the container body and the press restriction member extends in a vertical direction parallel to a vertical axis of the container body, and the other one of the side surface of the container body and the press restriction member extends at a linear angle with respect to the vertical axis.

2. The squeeze container according to claim 1, wherein an inner diameter of the container body within an arrayed range in which the measurement scale markings are arrayed in the vertical direction is formed to have a smaller diameter than an upper portion and/or a lower portion of the container body.

3. The squeeze container according to claim 1, wherein the press restriction member is tubular and does not deform due to pressing of the side surface of the container body from outside thereof.

4. The squeeze container according to claim 1, wherein a transverse sectional shape of an outer contour of the container body within an arrayed range in which the measurement scale markings are arrayed in the vertical direction is D-shaped comprising of an arc portion and a linear portion, and the measurement scale markings are provided on the side surface of the container body within the arc portion.

5. The squeeze container according to claim 4, wherein a distance between an inner wall of the container body within the linear portion and the press restriction member is constant.

6. The squeeze container according to claim 4, wherein the container body and the restriction member are located closer together on the side of the linear portion of the container body than on the side of the arc portion of the container body.

7. The squeeze container according to claim 1, wherein:

a transverse sectional shape of an outer contour of the container body within the arrayed range in which the measurement scale markings are arrayed in the vertical direction is convex within an arrayed area in which the measurement scale markings are arrayed and is substantially linear on an opposite side from the arrayed area; and a distance between an inner wall of the container body and the press restriction member differs within the arrayed area of the measurement scale markings depending on the positions where the measurement scale markings are provided, and is constant on the opposite side from the arrayed area.

8. The squeeze container according to claim 7, wherein, within the arrayed range in which the measurement scale markings are arrayed in the vertical direction, the restriction member and the inner wall of the container body in a back area thereof on the opposite side from the arrayed area of the measurement scale markings are located close together or are in contact with one another.

9. The squeeze container according to claim 1, wherein a transverse sectional shape of the container body within the arrayed range in which the measurement scale markings are arrayed in the vertical direction is D-shaped or circular.

10. The squeeze container according to claim 9, wherein a transverse sectional shape of the press restriction member within the arrayed range in which the measurement scale markings are arrayed in the vertical direction is either D-shaped substantially similar to the shape of the container body, semicircular, U-shaped, or flat.

11. The squeeze container according to claim 1, wherein:

the container body has a mouth that opens at the upper portion, the press restriction member is tubular, and an upper end opening of the restriction member is tightly attached to the mouth; and a nozzle cap is mounted on the mouth, and the squeeze container has a cover that is mounted on and covers up the nozzle cap.

12. The squeeze container according to claim 1, further comprising a nozzle disposed at a first end of the container body, wherein:

the press restriction member has a cylindrical or conical cylindrical shape that extends from the first end of the container body towards an opposing second end of the container body in the vertical direction; and the press restriction member includes a slit that extends along the press restriction member in the vertical direction to provide tactile feedback that the container body is pressed to the one of the limits to the deformation amount defined by the press restriction member.

13. The squeeze container according to claim 1, further comprising a nozzle disposed at a first end of the container body, wherein:

the press restriction member has a cylindrical or conical cylindrical shape that extends from the first end of the container body towards an opposing second end of the container body in the vertical direction; and the press restriction member includes a rib that extends along the press restriction member in the vertical direction to provide tactile feedback that the container body is pressed to the one of the limits to the deformation amount defined by the press restriction member.

14. The squeeze container according to claim 1, wherein the press restriction member is a plate-like member that extends from a dispensing end of the container body in the vertical direction of the container body.

15. The squeeze container according to claim 14, wherein the container body has a first side to be depressed and a second side that is less prone to depression, relative to the first side, the first and second sides coinciding with opposing side surfaces of the container body.

16. The squeeze container according to claim 15, wherein the second side is thicker than the first side.

17. The squeeze container according to claim 16, wherein:

a transverse sectional shape of an outer contour of the container body within an arrayed range in which the measurement scale markings are arrayed in the vertical direction is D-shaped comprising of an arc portion and a linear portion;

the first side includes the arc portion, and second side includes the linear portion; and the measurement scale markings are provided on the first side.

18. The squeeze container according to claim 1, wherein:

the press restriction member extends from a dispensing end of the container body in the vertical direction of the container body, and the press restriction member defines the limits such that the limits increase, thereby resulting in an increase in the discharge amount, as the position in the vertical direction extends away from the dispensing end in the vertical direction.

19. The squeeze container according to claim 1, wherein:

the press restriction member extends from a dispensing end of the container body in the vertical direction of the container body, and the press restriction member defines the limits such that the limits decrease, thereby resulting in a decrease in the discharge amount, as the position in the vertical direction extends away from the dispensing end in the vertical direction.

20. A squeeze container comprising:

a container body having flexibility, and press restriction means provided inside the container body for restricting, from inside the container body, deformation of the container body due to pressing of a side surface of the container body from outside thereof, a content liquid of the container being discharged by pressing the side surface of the container body from outside thereof, wherein:

the press restriction means defines limits to a deformation amount that the container body deforms based on a position in a vertical direction of the container body, such that the limits vary with respect to the vertical direction;

the side surface of the container body has an array of measurement scale markings that are arrayed in the vertical direction;

the deformation amount, for a particular position in the vertical direction, corresponds to a discharge amount of the content liquid that is discharged when the container body is pressed to one of the limits, such that the discharge amount corresponds to one of the measurement scale markings that coincides with the particular position in the vertical direction; and within a range in which the measurement scale markings are arrayed in the vertical direction on the side surface of the container body, one of the side surface of the container body and the press restriction member extends in a vertical direction parallel to a vertical axis of the container body, and the other one of the side surface of the container body and the press restriction member extends at a linear angle with respect to the vertical axis.

* * * * *